US009370241B1

(12) United States Patent
Dilmaghani et al.

(10) Patent No.: US 9,370,241 B1
(45) Date of Patent: Jun. 21, 2016

(54) TABLE STRUCTURE

(71) Applicant: Old New House LLC, Katonah, NY (US)

(72) Inventors: David Dilmaghani, Katonah, NY (US); Melissa Dilmaghani, Katonah, NY (US)

(73) Assignee: OLD NEW HOUSE LLC, Katonah, NY (US)

( * ) Notice: Subject to any disclaimer, the term of this patent is extended or adjusted under 35 U.S.C. 154(b) by 0 days.

(21) Appl. No.: 14/619,678

(22) Filed: Feb. 11, 2015

(51) Int. Cl.

| | |
|---|---|
| ***A47B 57/00*** | (2006.01) |
| ***A47B 13/00*** | (2006.01) |
| ***A47B 13/08*** | (2006.01) |
| ***A47B 13/02*** | (2006.01) |
| ***A47B 87/00*** | (2006.01) |

(52) U.S. Cl.
CPC ..... *A47B 13/003* (2013.01); *A47B 13/02* (2013.01); *A47B 13/08* (2013.01); *A47B 87/002* (2013.01)

(58) Field of Classification Search
CPC ..... A47B 3/06; A47B 13/021; A47B 2230/0085; A47B 2230/0088; A47C 4/021
USPC ..... 108/157.16, 158.12, 157.1, 92, 101, 108/181, 186, 56.1, 56.3, 57.19
See application file for complete search history.

(56) References Cited

U.S. PATENT DOCUMENTS

| | | | | | |
|---|---|---|---|---|---|
| 844,071 | A * | 2/1907 | Weston | A47B 3/12 | 108/101 |
| 2,657,964 | A * | 11/1953 | Watrous | 108/157.17 | |
| 2,921,691 | A * | 1/1960 | Dembinski | A47B 3/12 | 108/101 |
| 3,867,887 | A * | 2/1975 | Saidel | B65D 19/0028 | 108/53.3 |
| 4,193,650 | A * | 3/1980 | Gray | A47B 45/00 | 108/61 |
| 4,714,027 | A * | 12/1987 | Stern | 108/60 | |
| 5,492,069 | A * | 2/1996 | Alexander et al. | 108/56.3 | |
| 5,579,702 | A * | 12/1996 | Aho | 108/92 | |
| 5,584,253 | A * | 12/1996 | Stranford | 108/42 | |
| 5,666,886 | A * | 9/1997 | Alexander et al. | 108/56.3 | |
| 5,701,827 | A * | 12/1997 | Urabe | B65D 19/0012 | 108/180 |
| 5,709,158 | A * | 1/1998 | Wareheim | 108/186 | |
| 5,829,501 | A * | 11/1998 | DeVito | 144/286.1 | |
| 6,155,181 | A * | 12/2000 | Chilcutt | 108/51.3 | |
| 6,186,077 | B1 * | 2/2001 | Lim et al. | 108/56.1 | |
| 6,413,349 | B1 * | 7/2002 | Cannata | A47B 3/12 | 108/158.11 |
| 7,533,618 | B2 * | 5/2009 | Thomason | A47B 7/00 | 108/42 |
| 7,770,743 | B1 * | 8/2010 | Janowak et al. | 211/119.12 | |
| 8,113,129 | B1 * | 2/2012 | Hurley et al. | 108/51.3 | |
| 8,191,489 | B1 * | 6/2012 | Smith | 108/186 | |

(Continued)

OTHER PUBLICATIONS

Dezeen.com website: Wooden table by Ruben Beckers Jan. 17, 2014: http://www.dezeen.com/2014/01/17/wooden-table-by-ruben-beckers-weighs-just-4-5-kilograms/.

*Primary Examiner* — Hanh V Tran
(74) *Attorney, Agent, or Firm* — Donald J. Ranft; Kristen A. Mogavero; Collen IP

(57) ABSTRACT

A table created by a table structure with multiple openings extending from the top of the table structure to the bottom of the table structure. The table structure is deigned to be reversible and a solid top can be placed on the table structure. The table structure is supported by supporting structures connected to mounting attachments. The mounting attachments have one or more protrusions designed to provide secure attachment to the table structure by insertion into the openings in the table structure. Tiers can also be placed on the table structure. The table structure, the openings in the table structure, the mounting attachments, the supporting structures, the tiers, and the table and tier tops can be designed in limitless shapes and configurations.

18 Claims, 13 Drawing Sheets

(56) References Cited

U.S. PATENT DOCUMENTS

| | | | | |
|---|---|---|---|---|
| 8,215,245 | B2 * | 7/2012 | Morrison et al. | 108/91 |
| 2003/0042826 | A1 * | 3/2003 | Felsenthal | 312/237 |
| 2004/0226490 | A1 * | 11/2004 | Polumbaum | 108/56.1 |
| 2007/0186826 | A1 * | 8/2007 | Kuo | 108/56.3 |
| 2008/0098938 | A1 * | 5/2008 | Bernheimer et al. | 108/158.12 |
| 2008/0127865 | A1 * | 6/2008 | Tung-Cheng | 108/56.3 |
| 2008/0282942 | A1 * | 11/2008 | Hawkins | 108/157.1 |
| 2009/0320722 | A1 * | 12/2009 | Korbonski | 108/56.1 |

* cited by examiner

TABLE STRUCTURE

BACKGROUND

Standard tables are rigid and fixed with solid tabletops, often of limited or finite utility within the home. Other tables offering versatile features often rely on multi-person modifications with cumbersome frames, material, hardware or tools to meaningfully transform. Traditional tables are relatively heavy with rigid, pre-specified leg positions and fixed cabinets/drawers. Weight becomes a problem with shipping, and set leg placement is limiting.

This table addresses the weight aspect by having openings/holes in the surface thus requiring less material, designed with movable legs, dual sided performance for versatile placement of legs or added shelf level as needed. With the table enclosed herewith featuring a reversible table structure, each side may be built upon for custom needs, and may also be individually defined and unique in character for decorative versatility. These aspects add enormous versatility within the context of ever-changing living and work spaces.

SUMMARY

A versatile table with a table structure (2) designed to be usable on either side allowing the table to be reversed or flipped over. It thus provides equal utility on either side and allows easy addition of optional of additional tier(s). The table structure (2) is designed with numerous openings thus reducing the amount of material needed to create the table. The size and shape of the table are customizable in any configuration desired with easy assembly designed to allow rearrangement of moveable supporting legs/struts to the table and if desired to directly support a top surface which can be added. The table structure is adaptive to consumer's environment(s), preferences thereby enhancing utility, lifestyle and more productive use of space.

The openings create an aerated character for the table structure while being uniquely strong and lightweight due to the reduced material. Openings/channels in table structure (2) can be custom shaped, as can the table itself which may be specified by the user. The openings al allow insertion of mounting attachments connected to legs or other supporting structures.

PART NUMBERS

Figure 1:
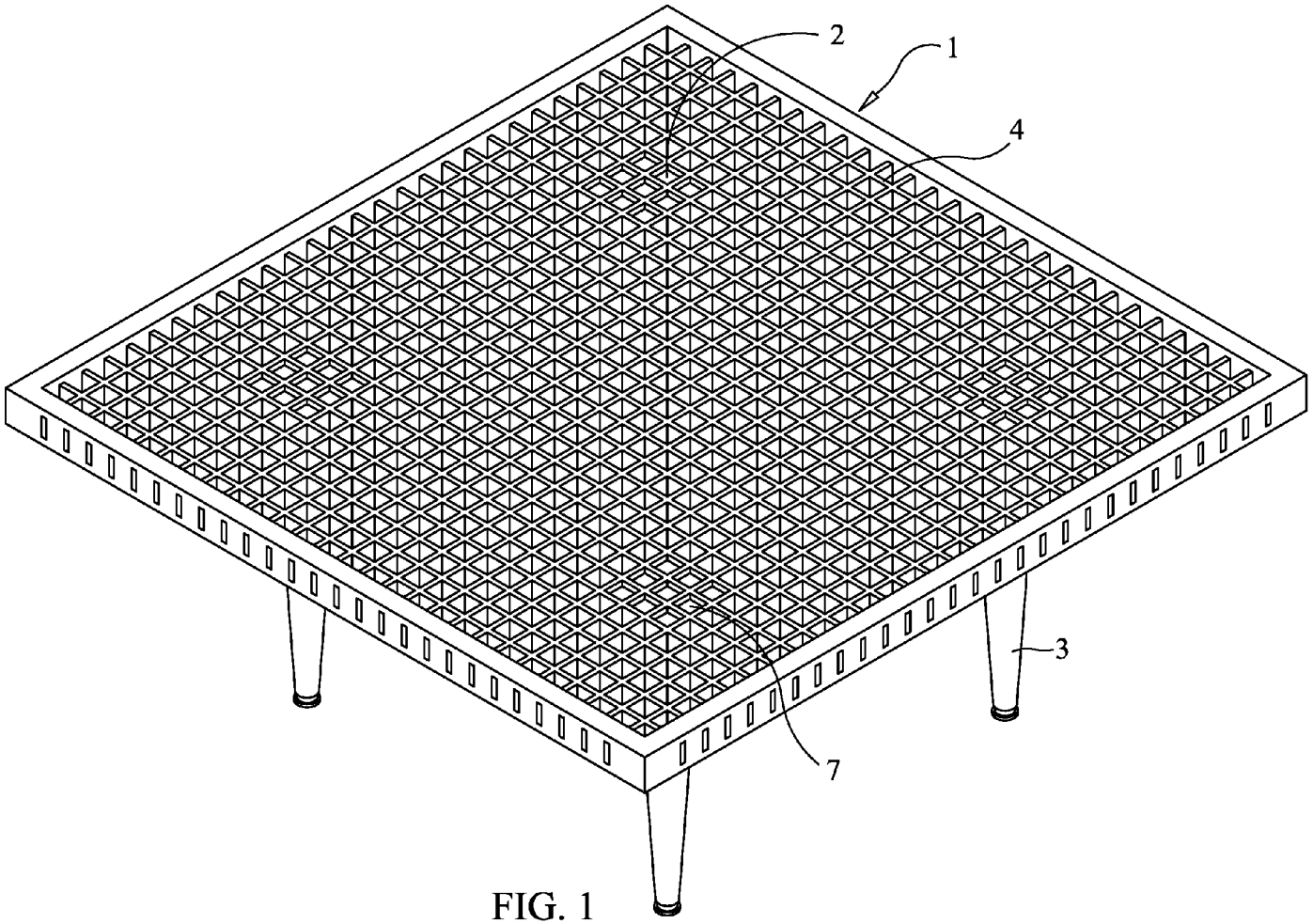
FIG. 1 is a top perspective view of a square table.

1—table
2—table structure
3—leg
4—structural member
5—mounting attachment
6—side/and rail
7—openings
8—mounting attachment protrusion
9—tier
10—tier leg
11—upper tier mounting attachment
12—lower tier mounting attachment
13—tabletop
14—circular opening
15—rectangular opening
16—triangular opening
17—circular structural member

DETAILED DESCRIPTION

As shown on the figures, the table (1) is designed with a table structure (2) which includes openings throughout the table structure (2). The table structure (2) openings extend from the top of the table structure to the bottom of the table structure.

In one embodiment the openings in the table structure (2) are created by a first set of structural members or slats (4) in parallel with each other extending from one outer edge of the table structure (2) to an opposite outer edge of the table structure (2). These structural members (4) are intersected by a second set of structural members or slats (4) in parallel to each other. For a rectangular table the second set of structural members extend from one side of the table structure (2) to an opposite side and are perpendicular to the first set of structural members. For other shapes of tables the second set of structural members may not extend from one outer edge of the table structure (2) to an opposite outer edge of the table structure (2). Other embodiments include the circular table as shown on FIG. 10 in which the second set of structural members (17) may be circular within the table.

The table structure (2) may be created in numerous ways including from multiple individual structural members/slats (4), created as a unit using a singular mold creating the openings, or created from a solid surface in which openings are cut out, carved, or drilled. Whether created of pieces or as a unit it. A 3*d* printer can be using to create the pieces, molds required, or the entire table structure.

In addition to reducing the mass of the table the openings (7) mounting attachments (5) to be interlocked with the table. The mounting attachments can be designed for mounting on legs (3) or other support structures for example attachment to filing cabinets, other table structures, other furniture, and or even be designed for attachment to walls. Multiple table structures can be connected to each other in an unlimited number of configurations utilizing mounting attachments as required. The mounting attachment can also be affixed to a supporting structure with multiple feet such as a mounting attachment connected at one spot on an arch shaped supporting structure with with multiple feet. The number, shape, and configurations for the supporting structures which are possible utilizing the mounting attachments, are unlimited. The unique interlocking ability of the mounting attachments (5) such as legs (3) to the table structure (2) enables easy assembly and customization of the location of the mounting attachment(s) (5) with minimal or no tools necessary.

The table structure (2) is designed to allow positioning of the mounting attachment (5) in different locations desired by a user. The number of openings (7) in the table structure (2) as well as their location and configuration can be chosen as desired. But as a minimum the number and location of the openings must be designed to enable proper support for the table structure (2) while allowing the mounting attachment (5) to be moved to different locations. Since the table structure is designed with openings in all regions of the table structure (2) this ensures the capability for insertion of mounting attachments (5) wherever needed.

The table structure (2) as shown in FIG. 1 may be used as a tabletop, or serve as a platform/underbelly to support optional rigid or semi-rigid tabletops (13) whether in full or partial sections.

Allowing users/owners of the table to determine and utilize the mounting locations for the mounting attachments (5) and supporting leg(s) (3) or other supporting structures, is particularly useful in confined or unusual spaces. This added benefit allows users to easily work around, and avoid encumbrances. Additional flexibility is provided to the user by the reversible table design. The top and bottom of the structural members (4), such as legs, can be different colors or designs for when table is flipped over. The openings spread throughout the table structure (2) with the resulting absence of material makes the table structure (2) a lightweight yet rigid structure with interlocking capacity for user specified configuration.

Figure 2:
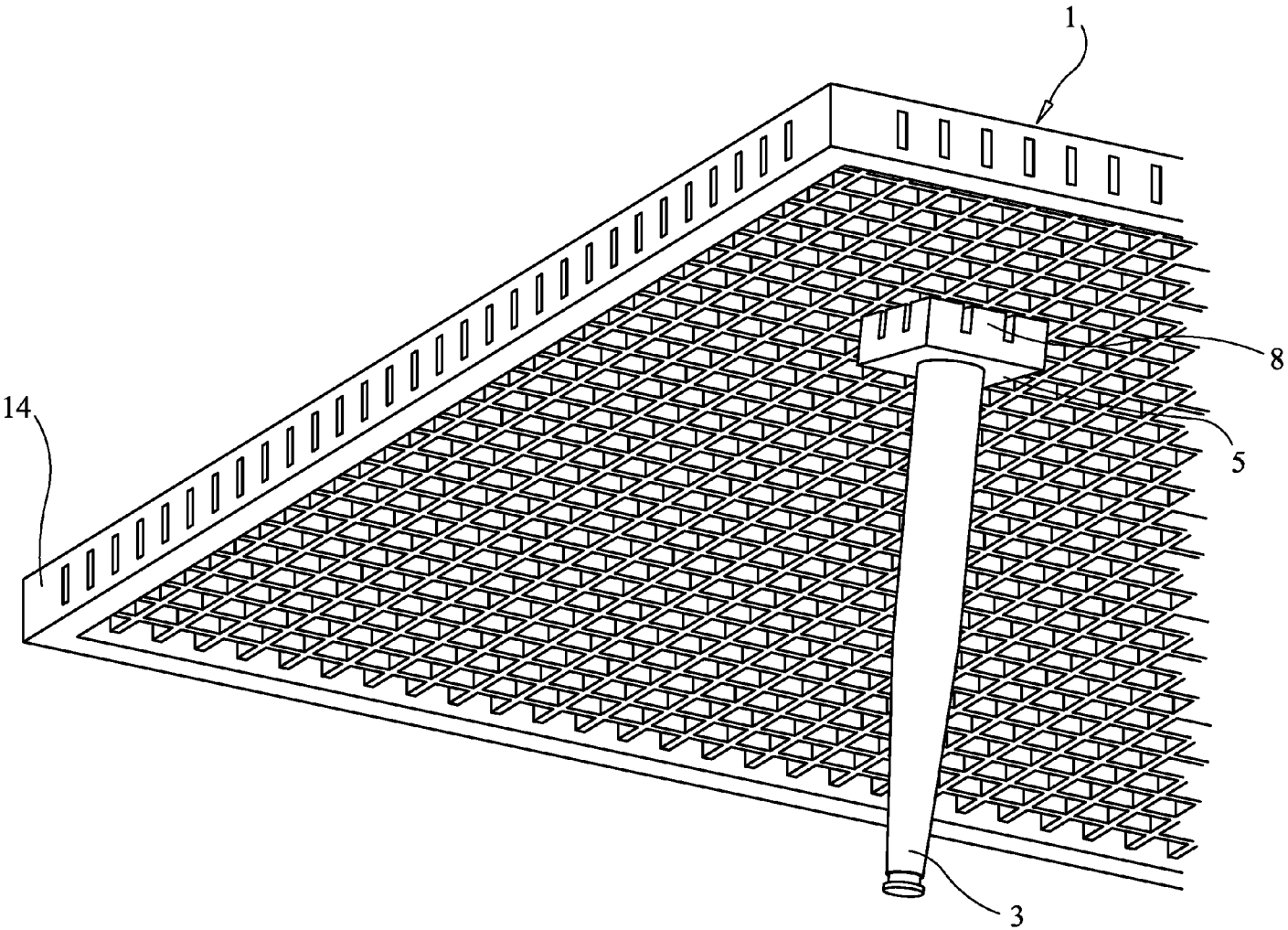
FIG. 2 is a bottom perspective view with a leg prior to attachment.

As shown on FIG. 2 the legs (3) or supports are designed with a mounting attachment (5) on top and including one or more protrusions (8) for insertion into one or more openings (7) in the table structure (2). As mentioned above the mounting attachments can also be mounted on other supporting structures. The protrusions (8) are designed to be compatible with and surrounded on all sides by the openings (7) in the table to ensure each protrusion is securely attached to the table structure once inserted. This allows the mounting attachments (5) to be inserted in nearly any of the compatible openings (7) of the table structure (2). Users may determine placement according to their unique needs, whether personal requirement or preference. Once the desired locations for mounting are determined, the user can attach the mounting attachments (5) to the table (1). Indications provided on the table structure itself or instructions provided with the table, may identify all regions requiring support. The regions requiring support are determined by considering the maximum distance from an edge of the table structure (2), and the minimum number of the mounting attachments (5) with support structures such as legs (3) required in order to provide sufficient support for a properly loaded table.

The rigid structure of the table structure (2) enables the placement of permanent or removable skins or tops (13) to be placed on top of the table structure (2). These tops (13) can provide a decorative element or can just be a flat surface if desired. If desired, tops (13) can be provided to cover only partial areas of the table. The tops (13) can be attached permanently or in a removable manner as desired by the user. Essentially any desired material can be used for the tops (13) plastic sheeting, glass, wood, stone, or composite material as a few examples.

Edge rails (6) may be added for esthetics, for additional rigidity to the table structure (2), and for retaining the table top surface (2). Rails (6) may also serve in part as added structure for additional customized legs. Rails (6) may independently be created in segment, entirety within a mold created for the entire table structure, or simply attached to slats as individual parts. Rails (6) may be comprised of one or more pieces and designed for assembly with limited or no hardware. Rails (6) may be shaped, beveled, flush with top or bottom of table structure, not flush with top or bottom of table structure, or otherwise stylized to suit the desired form. Rails (6) may also serve as custom mounting bracket for added features/attachments to the table structure (2). Rails (6) may be joined in each corner or turn with sweeping contours of a table structure (2). Rail ends may intersect with traditional joints, overlap, clip, cling, wrap, clasp, glued/bonded, or otherwise connected as desired.

Figure 8:
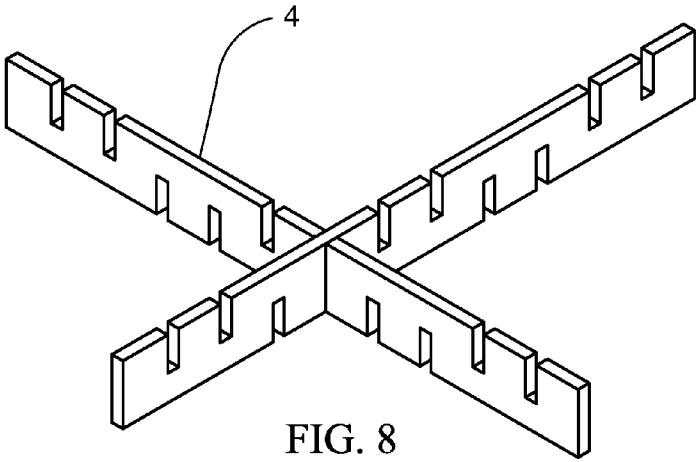
FIG. 8 is a top perspective view of individual slats used to create an embodiment of the table.
Figure 9:
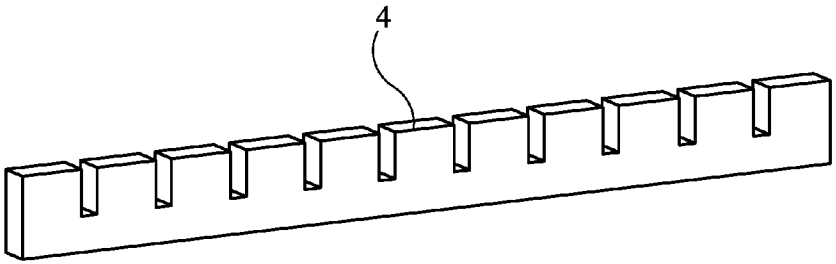
FIG. 9 is a top perspective view of an individual slat used to create an embodiment of the table.

The Individual structural members/slats (4), rails (6) used in one embodiment may be interlocked/joined utilizing compression and friction with a crossing interlocking slat as shown for example on FIG. 8. Or the slats (4) can be held together by clips, glue, nails, screws, interlocking end and side rails (6), fusion/melting/bonding, or any combination thereof. As shown on FIG. 8 in the instance of individual slats, reciprocating incremental notches may be exclusively on one side, or alternating in a customized pattern for unique keying.

As a dual sided table structure (2), mounting attachments (5) may be attached to either top or bottom of the table structure (2) in locations selected based on specific size and shape desired. Once the user has determined optimal mounting points for their utility needs, the mounting attachments (5) can be pressed into place, clamped, clipped, compressed, screwed, bolted or expanded into place with easy release reversible mounting hardware such as ball catch, magnetism or extracting technique. The protrusions (8) of the mounting attachments (5) may be partially recessed into table openings (7), or extend through the table to be flush with opposite outer surface of the table to provide direct support for a table top (13) or tier (9) if present.

Figure 3:
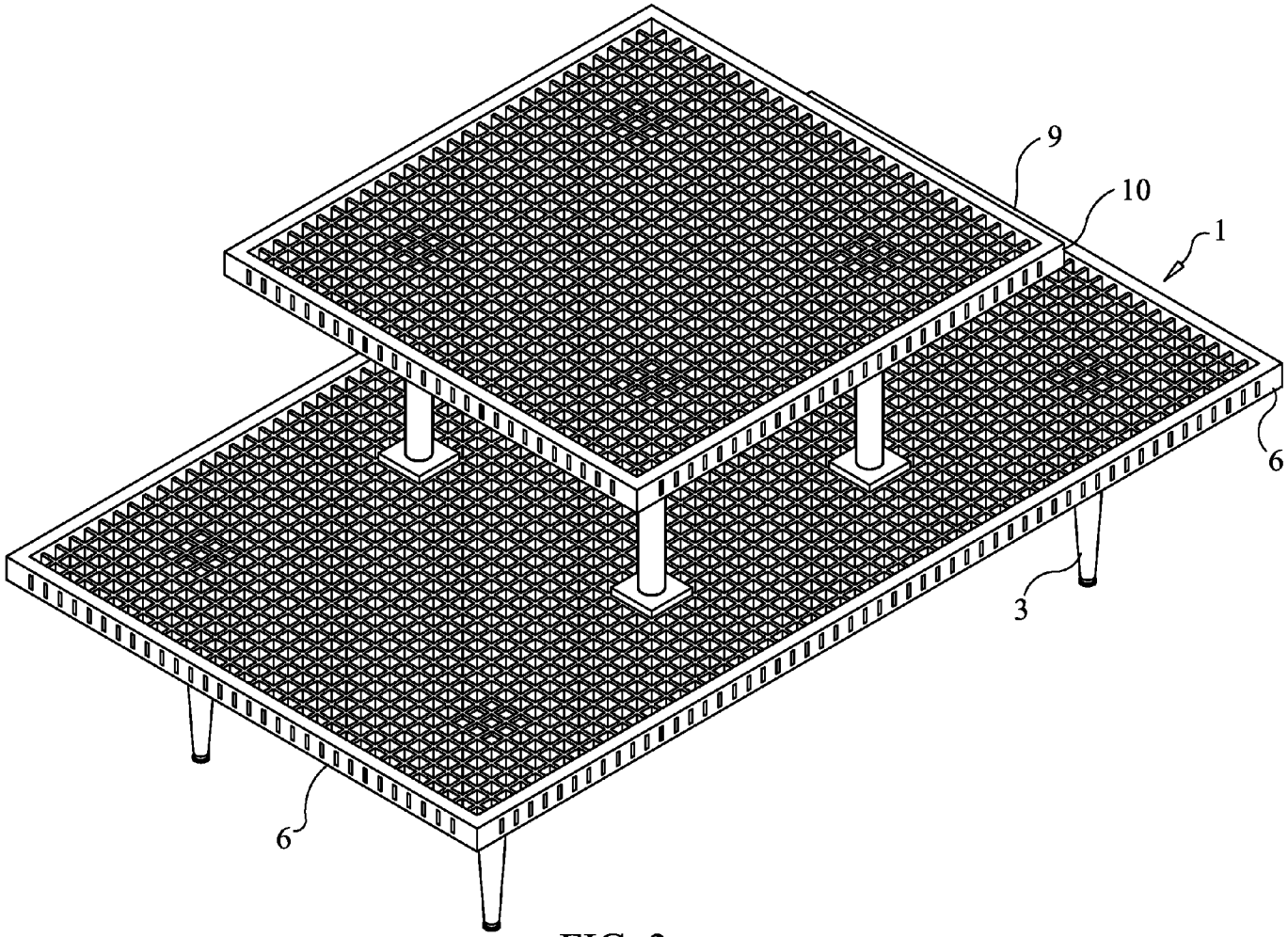
FIG. 3 is a top perspective view of a table with an additional tier on top.
Figure 4:
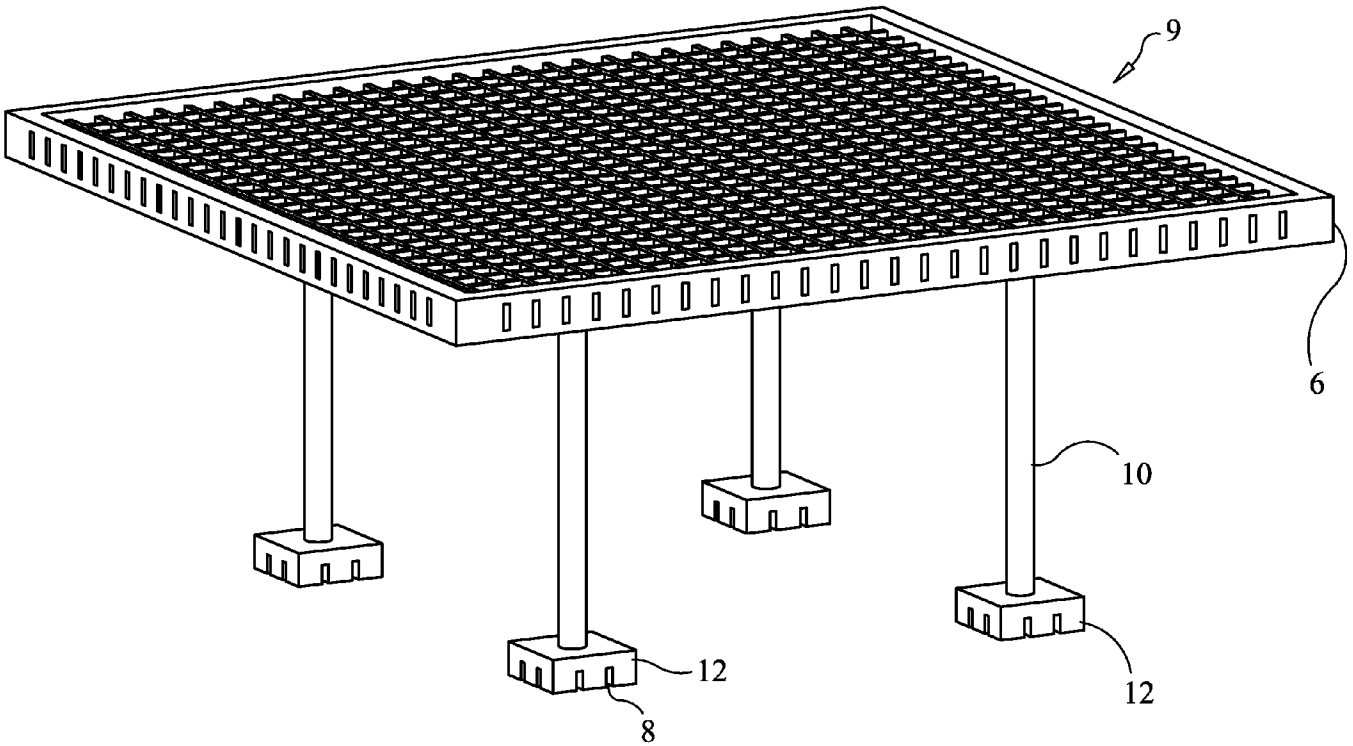
FIG. 4 is a perspective view of an additional tier for mounting on the table.
Figure 5:
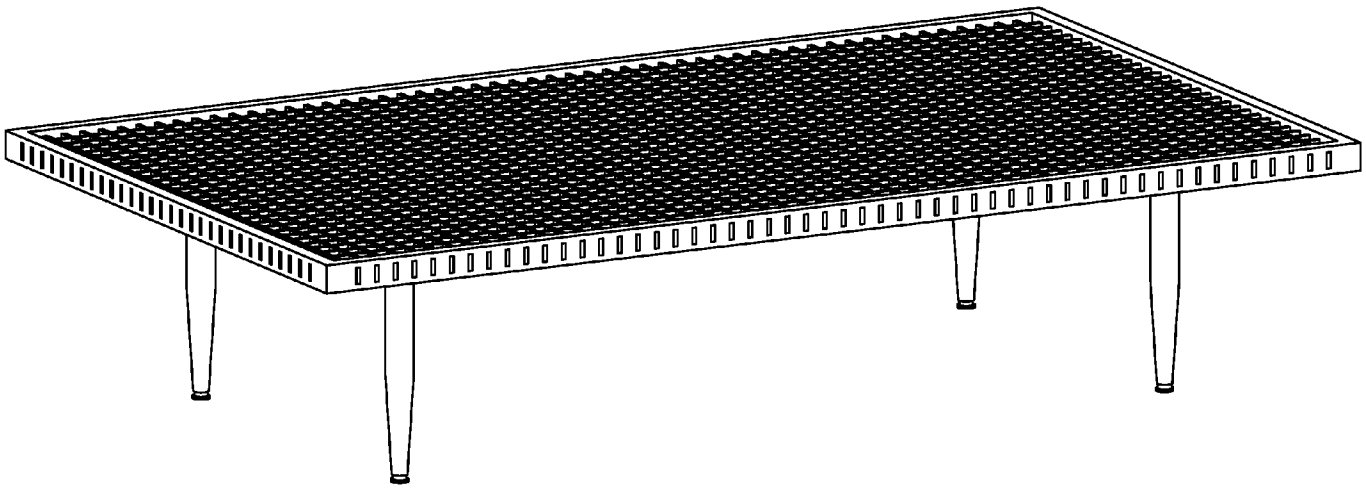
FIG. 5 is a top perspective view of a rectangular table.
Figure 6:
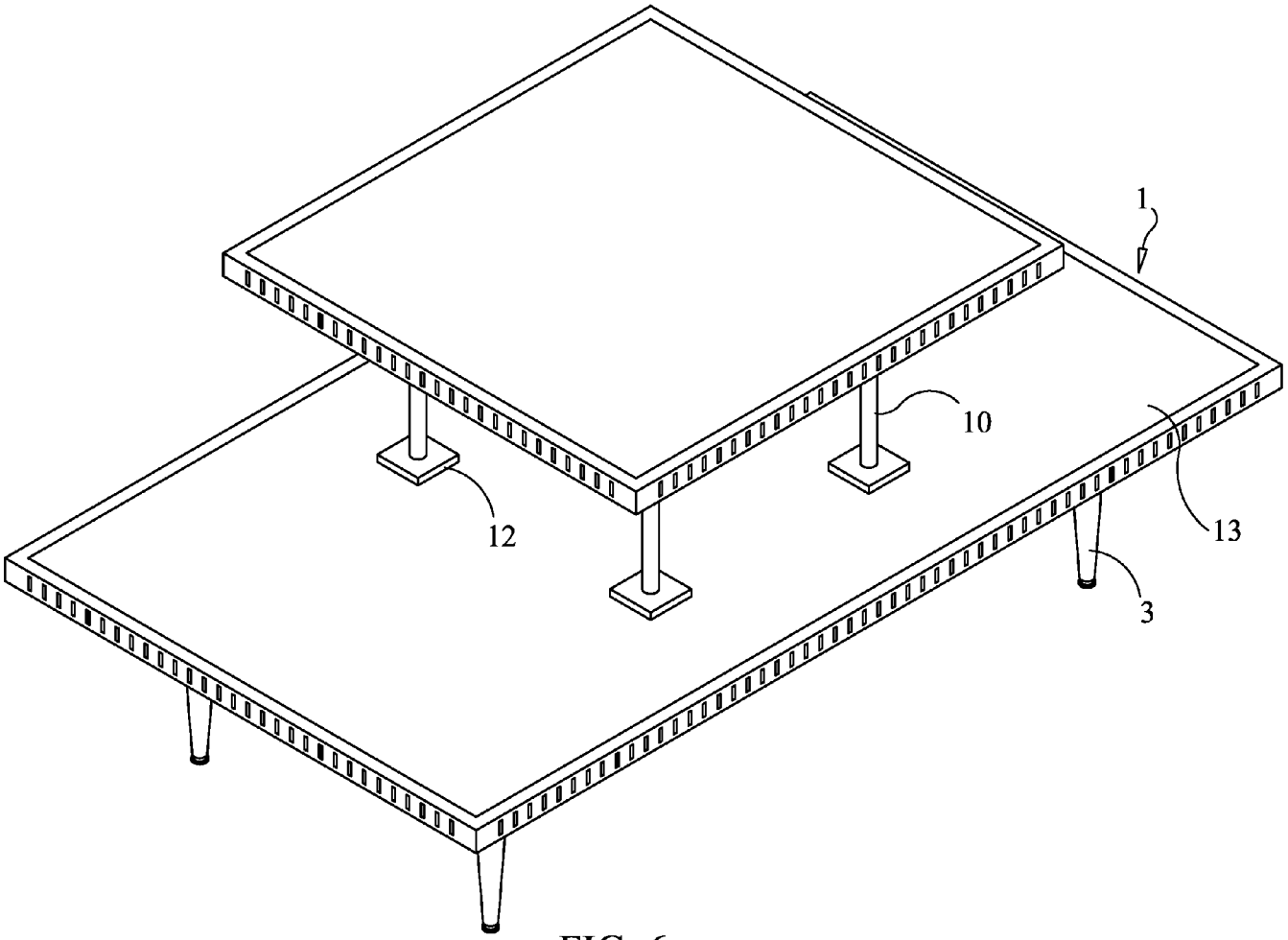
FIG. 6 is a top perspective view of a table with an additional tier on top and with solid surface tops added.
Figure 7:
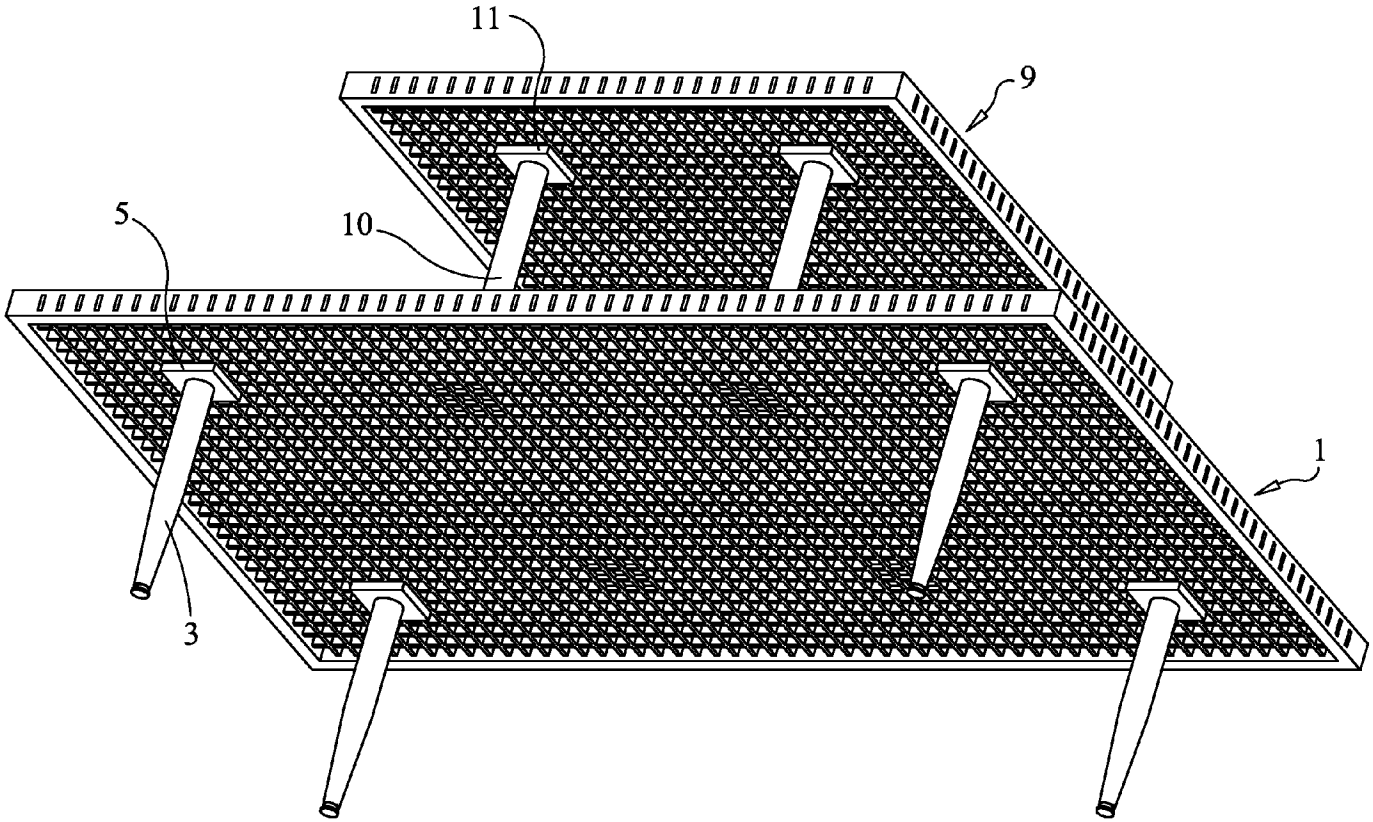
FIG. 7 is a bottom perspective view of an embodiment of the table with a tier on top.

One or more tier(s) (9) may be added on top of the table as shown on FIGS. 3 and 6. The tier is supported by one or more tier legs or struts (10). Each tier leg has an upper tier mounting attachments (11) on one end, which has protrusions (8) compatible with openings in the tier, and a lower tier mounting attachment (12) which has protrusions (8) compatible openings in the table structure, on an opposite end of the tier leg (10). The protrusions (8) for the table mounting attachments (5) and the protrusions (8) on the lower tier mounting attachment (12) (5) may be configured to meet each other in the middle of the table structure (2) thus providing direct support of the additional tier (9) through the connected supporting structure, such as a leg (3), to the ultimate supporting structure such as the floor.

Figure 10:
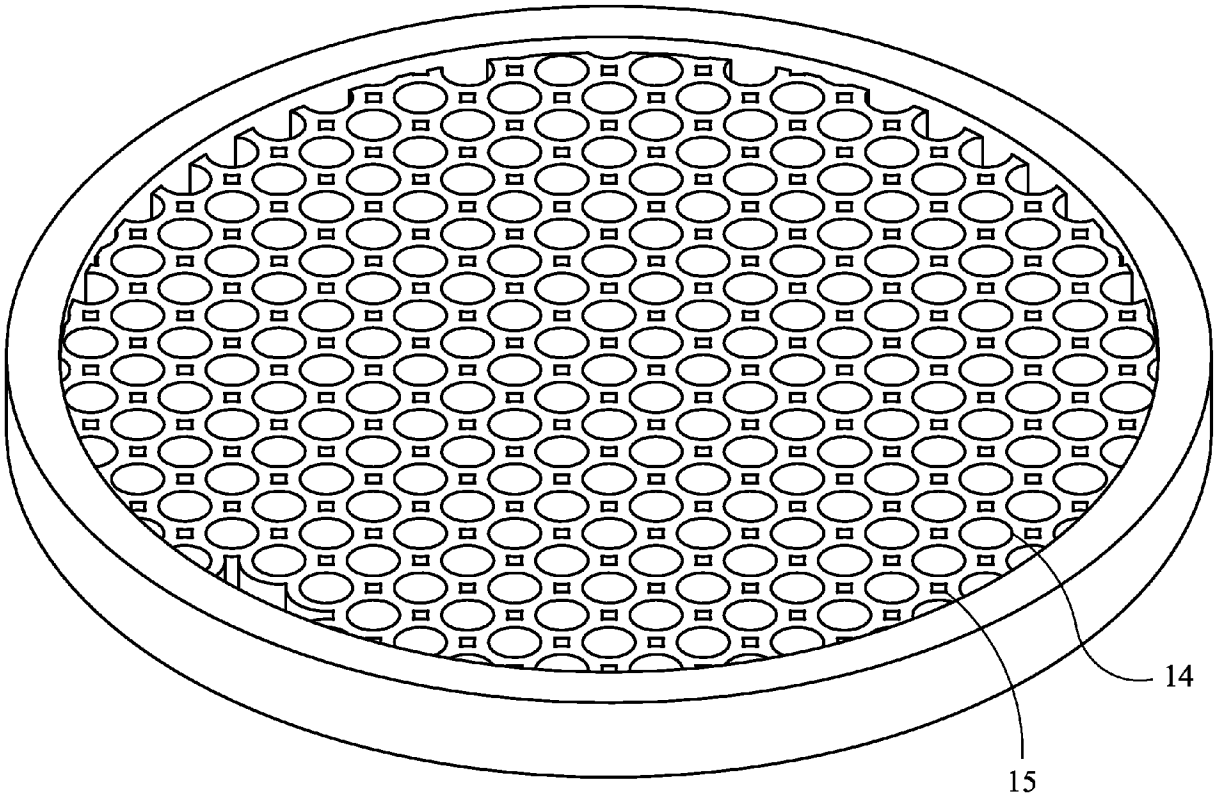
FIG. 10 is a top perspective view of a circular embodiment of the table structure with circular and rectangular openings.
Figure 11:
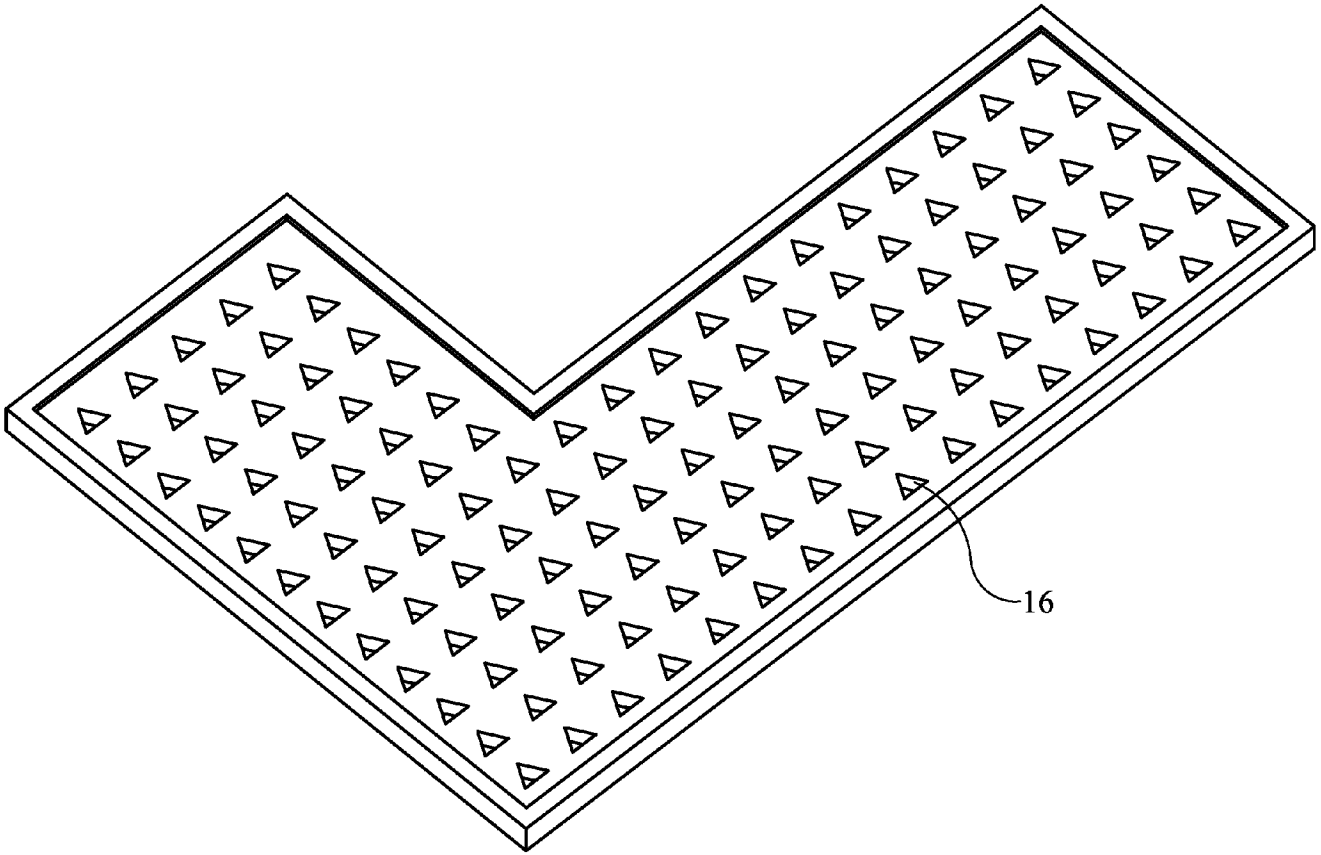
FIG. 11 is a top perspective view of an L-shaped table structure with triangular openings.
Figure 12:
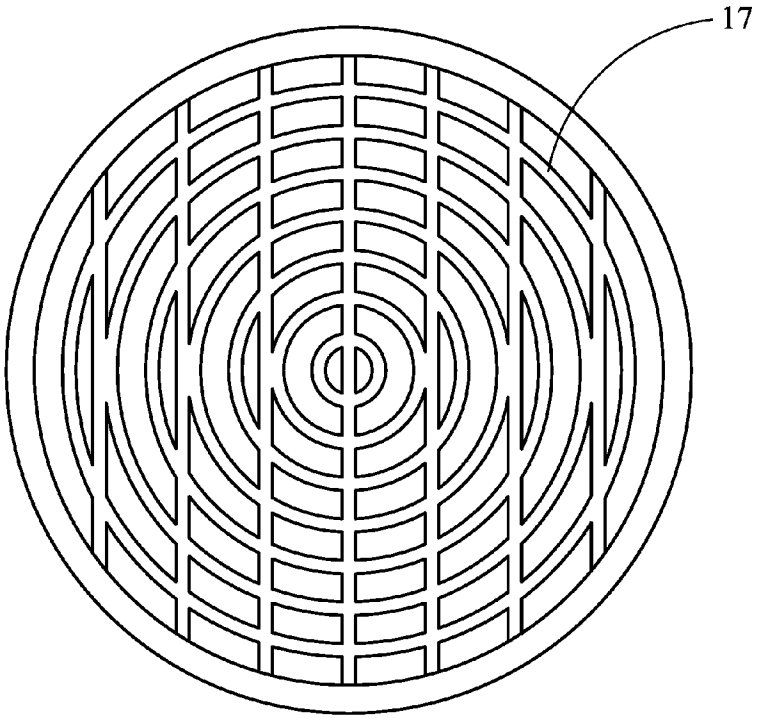
FIG. 12 is a top view of another embodiment of a circular table.
Figure 14:
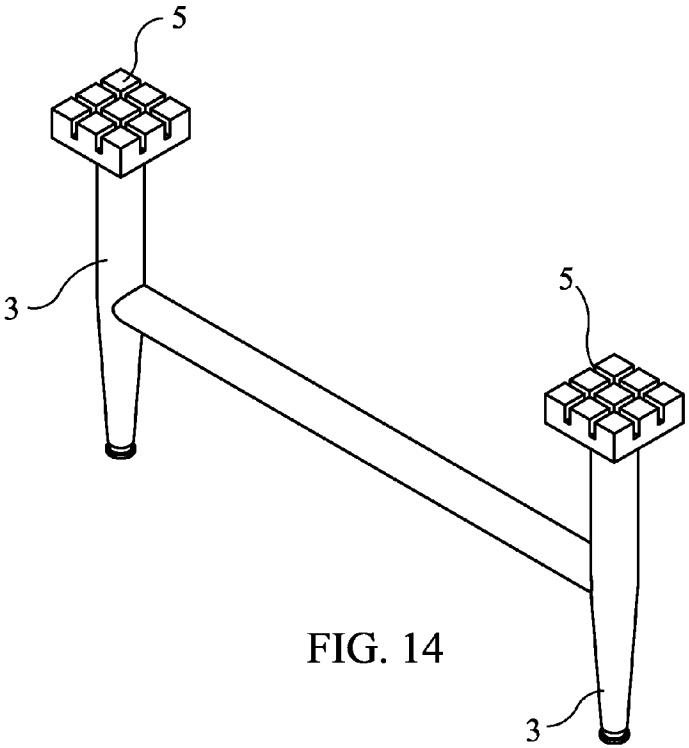
FIG. 14 is a view of one embodiment with multiple legs attached together.
Figure 13:
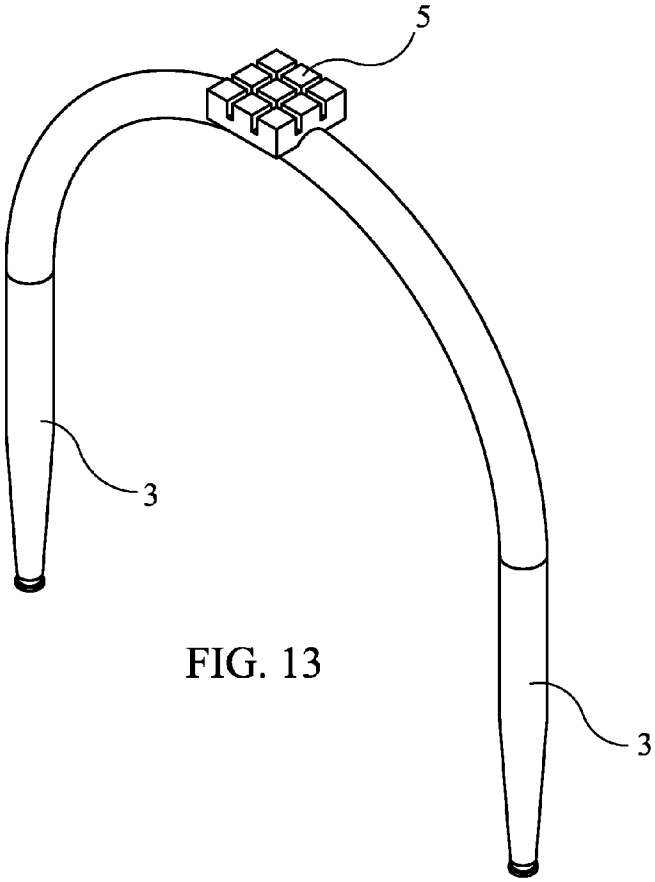
FIG. 13 is a view of one embodiment of a support structure with multiple feet.

The table structure (2) and any additional tier (9) are customizable in a limitless number of sizes and shapes including round, oblong, triangular, kidney bean, rectangular, square, custom shapes, heights and configurable options. The design and shape of the slats if used can also be varied as desired for example curved instead of straight. The openings/holes (7) in the table can be essentially any shape including: square, round, rectangular, trapezoidal, triangular, tapered or custom shape. Virtually any shape table with any shaped openings can be created and arranged for a table. FIGS. 10 and 11 are examples of additional configurations for a table and for the openings. FIG. 10 shows a circular table with circular (14) and rectangular (15) openings. FIG. 11 shows an L-shaped table with triangular openings (16).

Figure 15:
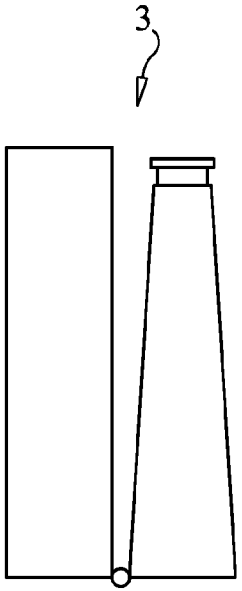
FIG. 15 is a view of one embodiment of a foldable leg.

The design and shape of the legs (3) can also be designed in various shapes as desired. The legs or other supporting structures can be designed to be foldable onto itself as shown on FIG. 15. And the mounting attachments (5) are designed to mate with the selected shape of the holes (7) in the table surface (2).

The table or design for the table can be furnished in various forms including:

1. Individual structural members (2) (such as shown on FIG. 8) with instructions for full assembly by user,
2. A kit consisting of pre-fabricated, partially or fully assembled table. Parts may be hollow or whole. Kit may include rails (6) and structural members (4), glass/wood/plastic or other surface/layered material table top covering, leg/support mounts and/or legs and added vertical supports. Pre-assembled parts and light hardware may include screws, washers, nuts, glue, clamps or other commonly known means for connecting modular parts for the table including rail and/or leg assembly.
3. A solid table surface with directions for carving, boring, drilling, other means for creating the holes (7).
4. Paper or electronic plans for creating the table or its parts.
5. Molds or designs for molds for use in creating the table in one piece or for creating parts of the table for assembly.
6. Electronic files for creating the table using 3D printing techniques.

The above illustrates various concepts, structures and techniques which are the subject of this application. It will now become apparent to those of ordinary skill in the art that other embodiments incorporating these concepts, structures and techniques may be used. Accordingly, it is submitted that the scope of the application should not be limited to the described embodiments but rather should be limited only by the spirit and scope of the following claims. For example the components disclosed can be configured as one section or other number of sections and designed to be mounted on different appropriate pedestals.

We claim:

1. A table comprising:

a table structure;

openings in all regions in the table structure extending from a top of the table structure to a bottom of the table structure;

at least two openings are located in regions of the table structure requiring support provided by a minimum of one supporting structure;

one or more mounting attachments having a minimum of two protrusions designed to be compatible for insertion into a minimum of two openings in the table structure;

the protrusions are designed to be compatible with and surrounded on all sides by the openings in the table to ensure each protrusion is securely attached to the table structure once inserted; and each mounting attachment connected to at least one supporting structure; wherein a user determines the location of the one or more mounting attachment in any region of the table structure according to the user's needs, such that the at least one supporting structure can be located in any region of the table structure;

a tier for placement on the top of the table structure comprising:

openings in the tier extending from a top of the tier to a bottom of the tier;

as a minimum the openings are located in all areas of the tier requiring support;

one or more tier legs having an upper tier mounting attachment on one end, and a lower tier mounting attachment on an opposite end of the tier leg;

each upper tier mounting attachment having a minimum of one protrusion designed to be compatible for insertion into one or more of the openings in the tier;

each lower tier mounting attachment having a minimum of one protrusion designed to be compatible for insertion into one or more of the openings in the table structure; and the protrusion on each lower tier mounting is designed to be able to meet the protrusion of the mounting attachment connected to the at least one supporting structure within the opening in the table structure in which both protrusions are inserted.

2. The table according to claim 1 wherein the at least one supporting structure is a leg.

3. The table according to claim 2 wherein the leg is foldable onto itself.

4. The table according to claim 2 wherein two or more legs are attached to each other.

5. The table according to claim 1 wherein at least one supporting structure has multiple feet.

6. The table according to claim 2 wherein the table structure is reversible such that the top of the table structure can become the bottom of the table structure, and the bottom of the table structure can become the top of the table structure.

7. The table according to claim 1 wherein the table structure is created by a first set of structural members extending from one outer edge of the table structure to an opposite outer edge of the table structure; and a second set of structural members in parallel to each other intersecting and interlocking with the first set of structural members.

8. The table according to claim 7 further comprising one or more rails on the one or more outer edges of the table structure.

9. The table according to claim 1 wherein the table structure is created from a mold.

10. The table according to claim 1 wherein the table structure is created by cutting holes in a solid surface.

11. The table according to claim 1 further comprising a top on the tier.

12. The table according to claim 1 further comprising a top on the table structure.

13. The table according to claim 1 wherein the table structure is a rectangular shape.

14. The table according to claim 1 wherein the table structure is a circular shape.

15. The table according to claim 1 wherein the table structure and legs are provided to a user as a kit for assembly.

16. The table according to claim 1 wherein the table structure is created in one piece.

17. The table according to claim 1 wherein the table structure and the one or more mounting attachment are created from a mold.

18. The table according to claim 1 wherein the table structure is created from intersecting slats.

* * * * *